United States Patent [19]

Abe et al.

[11] Patent Number: 4,458,639

[45] Date of Patent: Jul. 10, 1984

[54] CIRCUIT FOR CONTROLLING GLOW PLUG ENERGIZATION

[75] Inventors: Yoshiaki Abe; Hitoshi Sugimoto, both of Higashimatsuyama, Japan

[73] Assignee: Diesel Kiki Co., Ltd., Tokyo, Japan

[21] Appl. No.: 275,110

[22] Filed: Jun. 18, 1981

[30] Foreign Application Priority Data

Jun. 19, 1980 [JP] Japan ..... 55-82179

[51] Int. Cl.³ ..... F02P 19/02

[52] U.S. Cl. ..... 123/179 H; 315/209 R; 123/179 BG; 123/145 A

[58] Field of Search ..... 315/114, 116, 107, 209 R, 315/209 CD, 217, 225, 294; 361/264, 265, 266; 123/145 R, 145 A, 179 H, 179 BG

[56] References Cited

U.S. PATENT DOCUMENTS 4,088,109 5/1978 Woodruff et al. ..... 123/179 H
4,130,853 12/1978 Baker ..... 361/264
4,258,678 3/1981 Abe ..... 123/145 A X
4,300,491 11/1981 Hara et al. ..... 123/179 H X
4,307,689 12/1981 Raeske et al. ..... 123/145 A X

FOREIGN PATENT DOCUMENTS 0035407 9/1981 European Pat. Off. ..... 123/145 R
55-161975 12/1980 Japan ..... 123/145 R

*Primary Examiner*—Eugene R. Laroche
*Assistant Examiner*—Vincent DeLuca
*Attorney, Agent, or Firm*—Guy W. Shoup; Gerard F. Dunne

[57] ABSTRACT

In a glow plug energization control circuit wherein the output voltage produced from a glow plug temperature simulator composed of a charging/discharging circuit is compared with a reference voltage from a reference voltage generator and heating of the glow plug is controlled in accordance with the result of the comparison, the voltage developed across the glow plug is applied to the charging/discharging circuit to charge a capacitor thereof and the level of the reference voltage is changed in response to changes in the voltage of the voltage source by which the glow plug is heated.

12 Claims, 3 Drawing Figures

CIRCUIT FOR CONTROLLING GLOW PLUG ENERGIZATION

Figure 1:
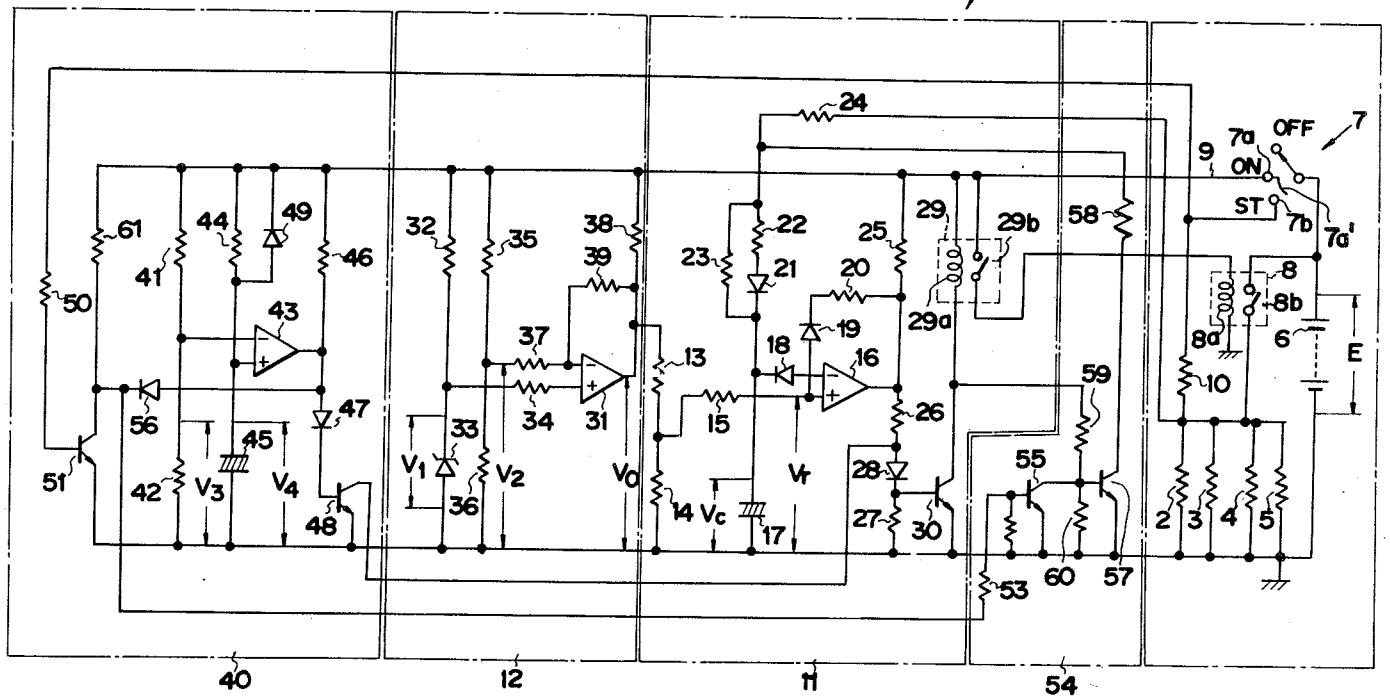
Figure 2:
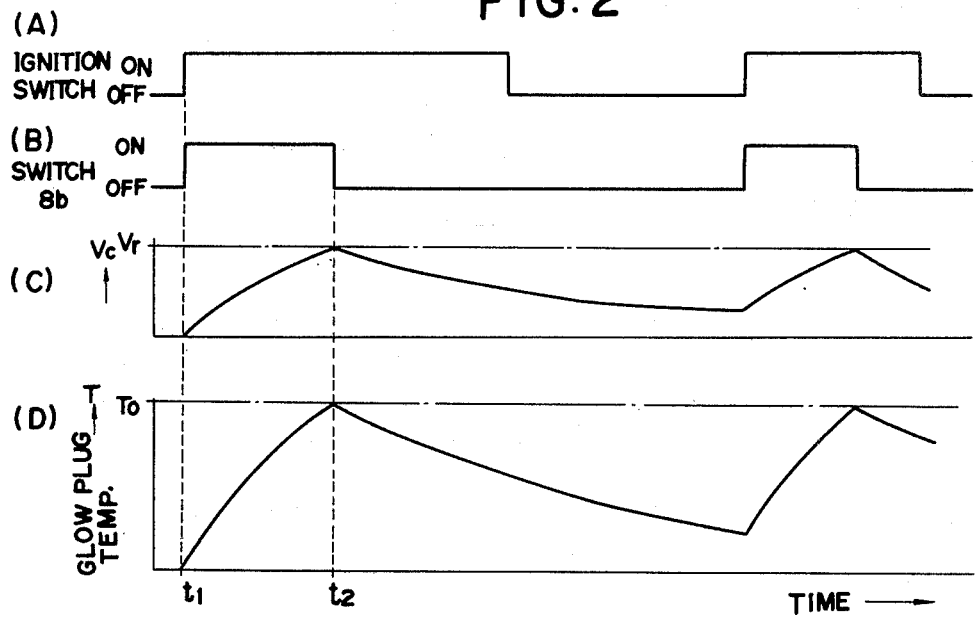
Figure 3:
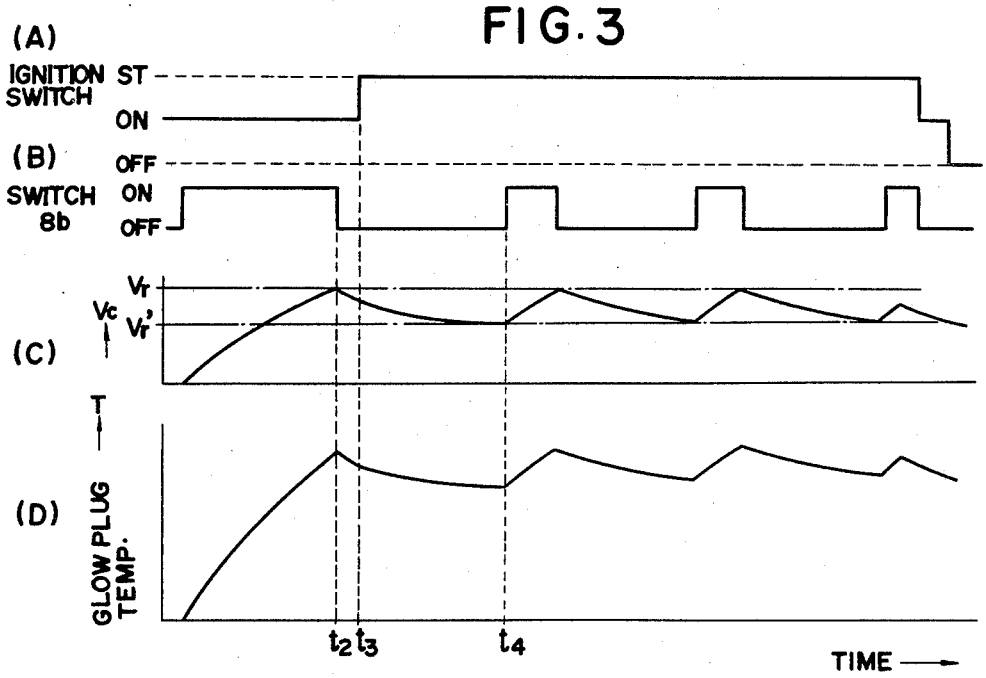

This invention relates to a circuit for controlling glow plug energization, and more particularly to a diesel engine glow plug energization control circuit which is capable of heating glow plugs to a predetermined temperature regardless of changes in the voltage of the power source.

As is well known, it is necessary to heat the glow plugs of a diesel engine so as to raise the temperature of the engine's combustion chambers prior to engine cranking. The conventional glow plug energization control circuit for this purpose is so arranged that a constant reference voltage stabilized by means of, for example, a zener diode is compared in level with an output voltage from a glow plug temperature simulator circuit including a capacitor, and the current flowing through one or more glow plugs is controlled in accordance with the results of the comparison. However, when such a constant voltage produced by a zener diode or the like is employed as a reference voltage, the voltage characteristics of the glow plugs cannot be fully compensated for even though the time period for preheating the glow plugs (that is, the time period for passage of the heating current) is extended proportionally as the battery voltage drops. As a result, the glow plug temperature is liable to be lower when the battery voltage is lower. Moreover, it is another disadvantage of the conventional circuit that when the engine is started during cold weather it tends to stop again since the temperature of the glow plugs decreases as the terminal voltage of the battery drops during cranking operation.

It is an object of the present invention to provide an improved circuit for controlling glow plug energization.

It is another object of the present invention to provide an improved circuit for controlling glow plug energization which is capable of heating the glow plugs to a predetermined temperature regardless of changes in the voltage of the power source.

It is a further object of the present invention to provide an improved circuit for controlling glow plug energization which can control the glow plug temperature free from the influence of changes in the ambient temperature.

It is still further object of the present invention to provide an improved circuit for controlling glow plug energization which can effectively prevent the remaining glow plugs from successively overheating when one of them burns out for whatever reason.

According to the present invention, there is provided a glow plug energization control circuit for use with diesel engines having at least one glow plug energized by actuation of an ignition switch having an OFF position, an ON position for connecting the circuit to a voltage source, and an ST position for starting the diesel engine, wherein said circuit comprises a switching means for controlling the supply of current to each glow plug, a generating means for generating a first voltage signal with a level which is determined in relation to a desired glow plug temperature and which is changed in magnitude in response to changes in the voltage level of said voltage source, a charging discharging circuit including a capacitor charged by a voltage across the glow plug for producing a second voltage signal the level of which is substantially indicative of the glow plug temperature, a comparing means for comparing the level of said first voltage signal with that of said second voltage signal, and an actuating means for closing/opening said switching means in response to the resulting output from said comparing means, whereby said glow plugs are preheated up to the desired temperature.

Further objects and advantages of the invention will be clear from the following detailed description to be read in conjunction with the accompanying drawings in which:

FIG. 1 is a schematic diagram of an embodiment of the present invention;

FIGS. 2(A) to 2(D) are timing charts for explaining the operation of the device illustrated in FIG. 1; and FIGS. 3(A) to 3(D) are timing charts for explaining the operation of the device illustrated in FIG. 1.

Referring to FIG. 1, there is shown an embodiment of a glow plug energization control circuit of the present invention, which controls the preheating condition of glow plugs 2 to 5 provided for the respective cylinders of a four cylinder diesel engine (not shown) by controlling the heating current flowing through the glow plugs 2 to 5 from a battery 6 when an ignition switch 7 is switched to its ON position or its ST position. One terminal of each of the glow plugs 2 to 5 is connected to the negative terminal of the battery 6 and is also grounded, and the other terminal of each is connected to the positive terminal of the battery through a switch 8*b* which is opened or closed by a coil 8*a* of a relay 8. A stationary contact 7*a* for the ON position of the ignition switch 7 is connected to a positive line 9 and a stationary contact 7*b* for the ST position of the ignition switch 7 is connected to the other terminals of the glow plugs 2 to 5 through a dropping resistor 10 for the sake of supplying heat maintenance current to the glow plugs 2 to 5. As can be seen from FIG. 1, the stationary contact 7*a* has an extension 7*a'* extending towards the stationary contact 7*b* to interconnect these stationary contacts when the ignition switch is moved to its ST position.

This circuit, which is designated as a whole by the numeral 1, comprises a quick preheating circuit 11 which rapidly preheats the glow plugs 2 to 5 up to a predetermined temperature when the ignition switch 7 is switched from the OFF position to the ON position. A reference voltage $V_0$ from a reference voltage generating circuit 12 is divided by resistors 13 and 14 and the divided voltage is applied through an input resistor 15 to the non-inverting input terminal of a comparator 16 of the quick preheating circuit 11. A charged voltage $V_c$ of a capacitor 17 is applied through a diode 18 to the inverting input terminal of the comparator 16. The comparator 16 further has its non-inverting input terminal connected to its output terminal through a diode 19 and a resistor 20. One terminal of the capacitor 17 is grounded and the other terminal thereof is connected to the other terminals of the glow plugs 2 to 5 through a diode 21 and resistors 22 to 24 so that the capacitor 17 is charged through the resistors 22 to 24 and the diode 21 by the voltage applied to the four glow plugs connected in parallel. In this case, since the diode 21 is connected to the capacitor 17 so as to be in the forward direction relative to the charging operation by the voltage across the glow plugs, the time constant of the charging operation is determined by the equivalent resistance value of the resistors 22 to 24 and the capacitance value of the capacitor 17.

The output voltage of the comparator 16 is divided by a series circuit of resistors 25 to 27 and a diode 28, and the divided voltage is applied to the base of a transistor 30, the collector circuit of which is connected to the coil 29*a* of a relay 29. A switch 29*b* of the relay 29 is connected in series with the coil 8*a* of relay 8. The time constant of a time constant circuit composed of the capacitor 17, the diode 21 and the resistors 22 to 24 is determined in such a way that the charged voltage characteristic thereof corresponds to the temperature changing characteristic of the glow plugs 2 to 5 so that the time constant circuit can act as a glow plug temperature simulator. Therefore, the charged voltage $V_c$ of the capacitor 17 can be used as a voltage signal indicative of the temperature of the glow plugs 2 to 5. Since the voltage developed across the glow plugs is applied to the time constant circuit including the capacitor 17, it is possible to prevent the glow plugs from being burned out in succession even if one of the glow plugs is burned out for some reason or other.

The reference voltage generating circuit 12 is a circuit for generating the reference voltage $V_0$ which is used for applying to the non-inverting input terminal of the comparator 16 a voltage $V_r$ corresponding to the value of the charged voltage $V_c$ obtained at the time the temperature of the glow plugs rises up to a desired value. In the circuit 12, a series circuit constituted of a resistor 32 and a zener diode 33 is connected between the positive line 9 and ground and a constant voltage $V_1$ produced across the zener diode 33 is applied to the non-inverting input terminal of an operational amplifier 31 through an input resistor 34. A series circuit constituted of resistors 35 and 36 is also connected between the positive line 9 and ground and the divided voltage $V_2$ produced across the resistor 36 is applied to the inverting input terminal of the operational amplifier 31 through an input resistor 37. The output terminal of the operational amplifier 31 is connected to the positive line 9 through a resistor 38 and is also connected to the non-inverting input terminal through a feedback resistor 39. Therefore, assuming that the resistance values of the resistors 37 and 39 are $R_1$ and $R_2$, respectively, the reference voltage $V_0$ will be represented by the following equation:

$$V_0 = V_1 + R_1/R_2(V_1 - V_2)$$

Insofar as the potential E of the positive line 9 varies only within a certain range, the value of $V_1$ will not be substantially changed even if the value of E changes. On the other hand, the value of $V_2$ changes in accordance with changes in the voltage E. As a result, as will be understood from the equation above, the voltage $V_0$ will increase when the voltage E decreases, whereas the voltage $V_0$ will decrease when the voltage E increases. The degree to which $V_0$ changes with a change in E can be selectively determined by selecting the value of the circuit elements. Thus, the reference voltage $V_0$ increases when the battery voltage E becomes less than the nominal value thereof and is decreased when it becomes more than the nominal value.

Moreover, in order to prevent changes in the ambient temperature from causing changes in the preheating temperature, a negative temperature coefficient type zener diode is employed as the zener diode 33 so that the value of $V_0$ changes in inverse proportion to the ambient temperature.

In order to prevent the quick preheating circuit 11 from quickly preheating the glow plugs again when the capacitor 17 is discharged through a discharging path (to be described in more detail hereinafter) whereby the condition becomes $V_0 < V_r$ after the quick preheating operation of the glow plugs is terminated and the engine is started, there is provided an inhibit circuit 40 having a comparator 43. A constant voltage $V_3$ divided by resistors 41 and 42 is applied to the inverting input terminal of the comparator 43, and the charged voltage $V_4$ of a time constant circuit composed of a resistor 44 and a capacitor 45 is applied to the non-inverting input terminal of the comparator 43. The output terminal of the comparator 43 is connected through a resistor 46 to the positive line 9 and is also connected through a diode 47 to the base of a transistor 48 the collector of which is connected to the connecting point between the diode 28 and the resistor 26. A diode 49 connected in parallel to the resistor 44 forms the discharging path for the capacitor 45. The time constant of the time constant circuit involving the capacitor 45 is determined in such a way that the time $t_a$ required for the value of $V_4$ to become larger than the value of $V_3$ becomes longer than the time $t_b$ required for the value of $V_c$ to become smaller than the value of $V_r$ after the ignition switch 7 is switched over from the OFF position to the ON position.

The inhibit circuit 40 moreover has a transistor 51 the base of which is connected through a resistor 50 to the stationary contact 7*b* of the ignition switch 7. The collector of the transistor 51 is connected to the positive line 9 through a resistor 61, to the base of a transistor 55 of a discharging circuit 54 through a resistor 53 and to the output terminal of the comparator 43 through a diode 56.

The discharging circuit 54 includes a transistor 57 the base of which is connected to the collector of the transistor 55 and the collector of which is connected through a resistor 58 to the connecting point between the resistors 22 and 24. The base of the transistor 57 is also connected to the connecting point between resistors 59 and 60 connected between the emitter and the collector of the transistor 30 so that a discharging path composed of the resistors 23 and 58 is formed for the capacitor 17 when the transistor 57 is turned ON.

Now, the operation of the circuit 1 will be described. When the ignition switch 7 is switched over from the OFF position to the ON position at the time of $t_1$ (see FIG. 2(A)), the positive line 9 is connected to the positive terminal of the battery 6 and electric power is supplied to the respective circuits. At this time, since the capacitor 17 has been discharged through the resistors 23 and 24 and the glow plugs 2 to 5, the charged voltage $V_c$ is approximately zero volts, and is less than the voltage $V_r$ so that the output level of the comparator 16 is of high level. Therefore, the transistor 30 is turned ON to energize the coil 29*a* of the relay 29 and the switch 29*b* is closed. Then, the switch 8*b* is also closed because the coil 8*a* is energized (FIG. 2(B)). As a result, the preheating current starts to flow through the glow plugs 2 to 5 and the glow plugs 2 to 5 are quickly preheated. When the battery voltage is applied to the glow plugs, the voltage across the glow plugs is applied to the time constant circuit including the capacitor 17 so that the charged voltage $V_c$ is increased in accordance with the predetermined charging characteristic (FIG. 2(C)). At this time, since the transistor 57 is in non-conductive condition because the transistor 30 is in conductive condition, no discharging path is yet formed for the capacitor 17. When the level of $V_c$ becomes equal to or larger than that of $V_r$ at the time $t_2$, the relays 8 and 29 are deenergized to stop the quick preheating operation for the glow plugs 2 to 5 because the output level of the comparator 16 becomes low to turn OFF the transistor 30. As described above, since the time constant value of the time constant circuit including the capacitor 17 is determined in such a way that the charging characteristic thereof corresponds to the heating characteristic of the glow plugs shown in FIG. 2(D) and the value of $V_r$ is selected to be equal to the value of the charged voltage $V_c$ at the time the glow plug temperature T reaches a predetermined temperature value $T_0$, it follows that the current flowing through the glow plugs is stopped at the time the temperature T reaches the value $T_0$. The circuit 1 may be so arranged that an indication lamp is turned OFF in response to the termination of the preheating operation.

When the transistor 30 is turned OFF, the capacitor 17 starts the discharging through the resistors 23 and 24 and the glow plugs 2 to 5. The discharge characteristic of the capacitor 17 in this case is made to correspond to the temperature decreasing characteristic of the glow plugs by adjusting the time constant value of the time constant circuit (FIG. 2(C), 2(D)). Although the charged voltage $V_c$ begins to decrease, since the comparing operation of the comparator 16 has hysteresis due to its feedback circuit, the output level of the comparator 16 does not immediately become high because of the lowering of the charged voltage $V_c$. Then, since the value of $V_4$ becomes larger than the value of $V_3$ to turn ON the transistor 48 before the output level of the comparator 16 becomes high again, the transistor 30 is held OFF regardless of the output level condition of the comparator 16 so that the glow plugs are prevented from being preheated by the quick preheating circuit 11 again.

The operation of the circuit 1 in the case that the ignition switch 7 is switched over from its ON position to its ST position after the termination of the quick preheating operation will be now described. When the ignition switch 7 is switched over from its ON position to its ST position at the time $t_3$, the transistors 51 and 57 are turned ON and the discharging path for the capacitor 17 is formed by the resistors 23 and 58. At the same time, the transistor 48 is turned OFF since the cathode of the diode 56 is grounded, and the operation of the inhibit circuit 40 is substantially stopped. The current is supplied to the glow plugs 2 to 5 through the resistor 10. The value of the resistor 10 is selected so that the glow plugs 2 to 5 gradually decrease in temperature under the current supplied therethrough. Therefore, as will be understood from FIGS. 3(A) to 3(D), the rate of temperature decrease between $t_2$ and $t_3$ is different from the rate of temperature decrease after $t_3$ namely the rate of temperature decrease after $t_3$ is more gradual than that between $t_2$ and $t_3$ (FIG. 3(D)). When the charged voltage $V_c$ reaches that of a new comparison voltage $V_r'$ the value of which depends upon the hysteresis characteristic of the comparing circuit including the comparator 16, the relays 8 and 29 are energized again (FIGS. 3(B) and 3(C)). As a result, the glow plugs 2 to 5 are directly connected to the battery 6 and are heated. Thus, when the glow plug temperature rises up to a predetermined value and the value of $V_c$ exceeds the value of $V_r$, the relays 8 and 29 are deenergized again and the heating current is supplied through the resistor 10 to the glow plugs. As long as the ignition switch 7 remains switched to its ST position, the above-mentioned operation will be repeated. Since, during the cranking operation, the preheating operation is carried out by supplying a predetermined amount of current to the glow plugs through the resistor 10, the time period of each operation of the relay 8 and 29 becomes longer than in the conventional circuit. Consequently, the relays and the glow plugs can be expected to have longer service lives.

With the circuit structure described above, since the level of the reference voltage $V_0$ produced by the reference voltage generating circuit 12 changes in magnitude in inverse proportion to the change in the battery voltage E, the level of the reference voltage $V_0$ is lowered to prevent the glow plugs from being overheated when the battery voltage E increases. Also, the level of the reference voltage $V_0$ is increased to prevent the glow plugs from being lowered in temperature when the battery voltage E decreases. As a result, the glow plugs are always preheated up to a desired preheating temperature even if the battery voltage E changes. Moreover, since the temperature coefficient of the zener diode 33 is selected to be a negative, the level of the reference voltage $V_0$ changes in magnitude in inverse proportion to the ambient temperature. Therefore, by selecting a zener diode with a proper temperature coefficient, it is also assured that the glow plugs are preheated up to the desired preheating temperature even if the ambient temperature changes.

While the above-mentioned embodiment of the present invention is a circuit for controlling the energization of four glow plugs provided for a four cylinder diesel engine, it will be well understood that the present invention may be applied to a diesel engine having any number of cylinders.

We claim:

1. A circuit for controlling glow plug energization for use with diesel engines having at least one glow plug energized by actuation of an ignition switch having an OFF position, an ON position for connecting said circuit to a voltage source and an ST position for starting the diesel engine, said circuit comprising:

a switching means for controlling the supply of current to each glow plug;

means for generating a first voltage signal with a level which is determined in relation to a desired glow plug temperature and which is changed in magnitude in response to the change in the voltage of said voltage source;

a charging/discharging circuit including a capacitor charged by the voltage across the at least one glow plug for producing a second voltage signal the level of which is substantially indicative of the glow plug temperature;

means for comparing the level of said first voltage signal with that of said second voltage signal; and an actuating means for closing/opening said switching means in response to the resulting output from said comparing means, whereby said at least one glow plug is preheated up to the desired temperature.

2. A circuit for controlling glow plug energization as claimed in claim 1 wherein said generating means has a constant voltage generator including a zener diode for producing a constant voltage regardless of the change in the voltage of said voltage source, a voltage dividing circuit for dividing the voltage of said voltage source and an amplifier for producing as said first voltage signal a voltage signal with a level changed in inverse proportion to the voltage change of said voltage source in accordance with the difference between the constant voltage and a divided voltage from said voltage dividing circuit.

3. A circuit for controlling glow plug energization as claimed in claim 2 wherein the temperature coefficient of the zener diode is selected to compensate for the effect of change in the ambient temperature on the plug preheating temperature.

4. A circuit for controlling glow plug energization as claimed in claim 1 wherein said charging/discharging circuit has a charging path used for simulating the rate of increase of the glow plug temperature and a discharging path used for simulating the rate of decrease of the glow plug temperature and a circuit responsive to the resulting output from said comparing means for rendering the discharging path operative or inoperative.

5. A circuit for controlling glow plug energization as claimed in claim 1 wherein said comparing means has a comparator with a hysteresis characteristic in its input level discriminating operation.

6. A circuit for controlling glow plug energization for use with diesel engines having at least one glow plug energized by actuation of an ignition switch having an OFF position, an ON position for connecting said circuit to a voltage source and an ST position for starting the diesel engine, said circuit comprising:

a switching means for controlling the supply of a first level of current to each glow plug, said first level of current being sufficient for heating each glow plug relatively quickly;

means for generating a first voltage signal with a level which is determined in relation to a desired glow plug temperature and which is changed in magnitude in response to the change in the voltage of said voltage source;

a charging/discharging circuit including a capacitor charged by the voltage across the at least one glow plug for producing a second voltage signal the level of which is substantially indicative of the glow plug temperature;

means for comparing the level of said first voltage signal with that of said second voltage signal, said comparing means having a hysteresis characteristic in its input level discriminating operation;

an actuating means for closing/opening said switching means in response to the resulting output from said comparing means, whereby said at least one glow plug is preheated up to the desired temperature;

means for providing a second level of current to each glow plug when said ignition switch is switched over to its ST position, said second level of current being that necessary for suppressing rapid decrease in the glow plug temperature; and means for inhibiting the operation of said actuating means after said switching means is once opened.

7. A circuit for controlling glow plug energization as claimed in claim 6 wherein said generating means has a constant voltage generator including a zener diode for producing a constant voltage regardless of the change in the voltage of said voltage source, a voltage dividing circuit for dividing the voltage of said voltage source and an amplifier for producing as said first voltage signal a voltage signal with a level changed in inverse proportion to the voltage change of said voltage source in accordance with the difference between the constant voltage and a divided voltage from said voltage dividing circuit.

8. A circuit for controlling glow plug energization as claimed in claim 6 wherein said charging/discharging circuit has a charging path used for simulating the rate of increase of the glow plug temperature and a discharging path used for simulating the rate of decrease of the glow plug temperature and a circuit responsive to the resulting output from said comparing means for rendering the discharging path operative or inoperative.

9. A circuit for controlling glow plug energization as claimed in claim 6 wherein said comparing means has a level comparing circuit receiving said first voltage signal and said second voltage signal and a feedback circuit for providing the level comparing circuit with a hysteresis characteristic.

10. A circuit for controlling glow plug energization as claimed in claim 9 wherein the feedback circuit is a series circuit constituted of a diode and a resistor and is connected between the output terminal and one input terminal of the level comparing circuit.

11. A circuit for controlling glow plug energization as claimed in claim 6 wherein said inhibiting means further includes a circuit for releasing the inhibiting condition for the operation of said actuating means in response to the switching over operation of said ignition switch from the ON position to the ST position, whereby the heating operation by said first level of current is intermittently carried out while said second level of current is provided to the at least one glow plug as long as the ignition switch is switched over to the ST position.

12. A circuit for controlling glow plug energization as claimed in claim 6 further comprising a discharging circuit responsive to the switching operation of said ignition switch from ON position to ST position for establishing a discharging path for the capacitor.

* * * * *